US010837148B2

(12) United States Patent
Gerrard et al.

(10) Patent No.: US 10,837,148 B2
(45) Date of Patent: Nov. 17, 2020

(54) SURFACE MOUNT SECURITY BARRIER

(71) Applicants: Robert Gerrard, Coventry (GB); Marcus Gerrard, Coventry (GB)

(72) Inventors: Robert Gerrard, Coventry (GB); Marcus Gerrard, Coventry (GB)

( * ) Notice: Subject to any disclaimer, the term of this patent is extended or adjusted under 35 U.S.C. 154(b) by 138 days.

(21) Appl. No.: 16/320,050

(22) PCT Filed: Jul. 24, 2017

(86) PCT No.: PCT/EP2017/068699
§ 371 (c)(1),
(2) Date: Jan. 23, 2019

(87) PCT Pub. No.: WO2018/019798
PCT Pub. Date: Jan. 2, 2018

(65) Prior Publication Data

US 2019/0226167 A1 Jul. 25, 2019

(30) Foreign Application Priority Data

Jul. 25, 2016 (GB) ..... 1612876.1

(51) Int. Cl.
*E01F 13/00* (2006.01)
*E01F 13/02* (2006.01)
*E01F 13/12* (2006.01)

(52) U.S. Cl.
CPC ..... *E01F 13/028* (2013.01); *E01F 13/12* (2013.01)

(58) Field of Classification Search
CPC ..... E01F 15/06; E01F 15/08; E01F 13/028
(Continued)

(56) References Cited

U.S. PATENT DOCUMENTS 1,680,548 A * 8/1928 Keiser ..... E01F 15/06 256/13.1
1,895,670 A * 1/1933 Langenheim ..... E01F 15/025 256/48
(Continued)

FOREIGN PATENT DOCUMENTS

DE 20019889 U1 3/2001
EP 0258585 A2 * 3/1988 ..... E01F 13/00
(Continued)

OTHER PUBLICATIONS

Combined Search and Examination Report issued by IPO in connection with GB1612876.1 dated Jan. 23, 2017.

*Primary Examiner* — Thomas B Will
*Assistant Examiner* — Katherine J Chu
(74) *Attorney, Agent, or Firm* — Levenfeld Pearlstein, LLC

(57) ABSTRACT

The invention provides a security barrier section (10) which has first (12) and second (14) barrier islands and cables (28, 30) there between. Each barrier island comprises a cast concrete block (16) having a front face and a rear face and a spring steel post (22) extending upwardly from a top face of the cast concrete block at a location between the front face and the rear face. An attachment means (26) is located on, or extending from, at least one of the front face and the rear face. At least one first cable (28) extends between the spring steel posts (22) of said the first (12) and second (14) barrier islands and is attached thereto by cable attachments. At least one second cable (30) extends between the attachment means (26) of said first (12) and second (14) barrier islands and is also attached thereto by cable attachments. The cable attachments are configured to allow said cable to slip in said cable attachment under loading.

20 Claims, 7 Drawing Sheets

(58) Field of Classification Search
USPC ..... 256/13.1
See application file for complete search history.

(56) References Cited

U.S. PATENT DOCUMENTS 2,007,466 A * 7/1935 Campbell ..... E01F 15/0438 256/13.1
2,051,465 A * 8/1936 Brickman ..... E01F 15/0423 256/13.1
2,085,058 A * 6/1937 Wood ..... E01F 15/025 256/13.1
2,204,556 A * 6/1940 Ahles ..... E01F 15/06 256/13.1
2,204,557 A * 6/1940 Ahles ..... E01F 15/06 256/13.1
2,248,422 A * 7/1941 Brickman ..... E01F 15/06 256/13.1
2,317,249 A * 4/1943 Brickman ..... E01F 15/06 248/66
2,646,969 A * 7/1953 Hendrickson ..... E01F 15/04 256/13.1
3,077,339 A * 2/1963 White ..... E01F 15/0453 256/13.1
3,292,909 A * 12/1966 Bianchi ..... E01F 7/06 256/13.1
3,614,844 A * 10/1971 Withers ..... E06B 11/00 49/170
4,681,302 A * 7/1987 Thompson ..... E01F 8/0035 256/13.1
5,387,049 A 2/1995 Duckett
5,425,594 A * 6/1995 Krage ..... E01F 15/086 256/13.1
5,605,413 A * 2/1997 Brown ..... E01F 15/025 256/13.1
5,651,635 A * 7/1997 Nagle ..... E01F 15/083 256/13.1
5,676,350 A * 10/1997 Galli ..... E04H 12/2238 256/13.1
6,669,402 B1 * 12/2003 Davis ..... E01F 15/086 256/13.1
7,708,492 B2 * 5/2010 Carey ..... E01F 15/088 404/6
8,277,143 B2 * 10/2012 Adler ..... E01F 9/685 404/6
8,777,510 B2 * 7/2014 Maus ..... E01F 15/088 404/6
9,133,590 B2 * 9/2015 Ball ..... E01F 15/003
10,233,601 B2 * 3/2019 Gerrard ..... E01F 15/146
2003/0007832 A1 1/2003 Carter
2003/0086761 A1 * 5/2003 Anderson ..... E01F 13/12 404/6
2006/0091371 A1 * 5/2006 Cox ..... E01F 7/045 256/13.1
2009/0315007 A1 * 12/2009 Cox ..... E01F 7/045 256/13.1
2014/0010591 A1 * 1/2014 Ball ..... E01F 9/685 404/6
2014/0246638 A1 9/2014 Anson et al.
2015/0292170 A1 * 10/2015 Cochrane ..... E01F 15/083 256/13.1
2016/0060830 A1 * 3/2016 Muegerl ..... E01F 15/083 404/6
2016/0194841 A1 * 7/2016 Sicking ..... E01F 15/146 404/6
2017/0268189 A1 * 9/2017 Heinevik ..... E01F 15/06
2018/0320405 A1 * 11/2018 Matthews ..... E04H 17/16
2020/0199834 A1 * 6/2020 Stone ..... E01F 15/003

FOREIGN PATENT DOCUMENTS

GB 2188662 A * 10/1987 ..... E01F 13/02
WO 8808057 A1 10/1988
WO 2014083336 A1 6/2014
WO 2015033100 A1 3/2015

* cited by examiner

SURFACE MOUNT SECURITY BARRIER

This is a National Stage Application of International Patent Application No. PCT/EP2017/068699, filed Jul. 24, 2017, which claims the benefit of and priority to Great Britain (GB) Patent Application Nos. 1612876.1, filed Jul. 25, 2016, the entirety of which is incorporated fully herein by reference.

TECHNICAL FIELD

The present invention relates to a security barrier section, a security barrier and a security barrier island, in particular for use in a surface mounted security barrier to prevent vehicular penetration.

BACKGROUND

Security barriers, or crash barriers, the main purpose of which being to prevent the passage of vehicles, are widely known in the art and have many applications. Common applications are for bordering dangerous sections of roads, providing a central separation between lanes of traffic moving in opposite directions, and around secure areas, for example around the entrance to airports or the like.

Known security barriers are generally made of metals, in particular steel, and comprise a post, which is bedded in concrete, and to which a barrier is attached. To provide the structural integrity to stop a car moving at around 40 to 50 km/h (about 25 to 30 mph), such barriers need a very deep, reinforced bedding of around a meter in depth and, for larger trucks, a bedding of up to two meters, into which the posts are set. As well as the obvious disadvantages in terms of the amount of material needed and the increased complexity of excavating to the required depth, the necessity of burying the posts to such a depth often interferes with existing buried services, for example electricity cables and sewage or water pipes. Although many are marked and can be anticipated during the planning stage, the discovery of pipes during deep excavation is common and necessitates halting excavation until the nature of the pipe/cable has been ascertained. One typical design of security fencing comprise a number of posts with tensioned steel cables between them. These fences typically run in lengths of in excess of a minimum of 50 meters, usually in excess of 100 meters. They generally comprise a large end stop which will have a very large mass of concrete embedded in the ground, and against which the cables are tensioned. These systems have a number of problems associated with them. One of the problems is that if the fence is installed in uneven ground, i.e., if there is not a level line of sight between the two ends of the fence, between which the cables are tensioned, then tensioning the cable will place a load on each post, either pushing it into, or pulling it out of, the ground.

Another type of barrier is disclosed in WO2015033100 which mitigates some of the problems associated with the necessity to have long runs of cable fence with massive end stops, however these security fences still require excavation.

Both known previous designs have the further problem that, due to the necessary excavation and underground structure, they are permanent installations and cannot be quickly installed and removed, for example where a temporary barrier that is only required for a short period of time before being removed, for example at a specific event like a music festival or political convention, is needed.

It is the purpose of the present invention to provide an improved security barrier that at least partially mitigates the problems associated with the existing designs

STATEMENT OF INVENTION

According to an aspect of the invention there is provided a security barrier section comprising: first and second barrier islands, each said island comprising: a cast concrete block having a front face and a rear face; a spring steel post extending upwardly from a top face of the cast concrete block at a location between the front face and the rear face; and attachment means located on, or extending from, at least one of the front face and the rear face; at least one first cable extended between the spring steel posts of said first and second barrier islands and attached thereto by first cable attachments; at least one second cable extended between the attachment means of said first and second barrier islands and attached thereto by second cable attachments; wherein said first and second cable attachments are configured to allow said cable to slip in said cable attachment under loading. The at least one first cable may comprise a plurality of cables extending between the spring steel posts.

It will be understood that by locating the spring steel posts between the front and the rear face on the top face of the concrete blocks, and locating the second cables on at least one of the front and back face, that the second cables are spaced from the first cables by a distance substantially equal to the distance between the front face of the concrete block and the spring steel post. This spacing is an important part of the invention as by placing the second cables lower than and spaced from the spring steel posts (and therefore the first cables) in the direction of protection, in the event of an impact a vehicle will collide with and pass over the second cable(s) before impacting on the first cable(s). The advantage of this is that the vehicle substantially then acts as an anchor for the barrier section in the immediate locality of the impact and prevents the force of the collision from causing the barrier section islands to become airborne. Once a barrier becomes airborne it usually suffers catastrophic failure, has little further resistance and, as such, cannot prevent vehicular penetration.

As used herein the terms front and rear face are used to denote the faces of the concrete block that are substantially parallel to the direction along which the security barrier section runs. In embodiments having only one second cable it will be appreciated that the security barrier section is designed to protect against a vehicle impacting from the direction of the front or rear face to which the second cable is attached. It will also be understood that in embodiments having a second cable on both of the front and the rear faces the design is substantially symmetrical and therefore offers protection from an impact in both directions, i.e. from a direction of the front face or the direction of the rear face.

The barrier of the invention has the advantage that it can be quickly installed without the need for permanent attachment or to be embedded in the surface on which it is located and under impact the ability for the first and second cables to slip enables a small proportion of the initial energy of impact to be absorbed prior to the post and the block to which the cables are attached experiencing the full impact of the collision, thereby reducing loading on these parts.

The at least one first and at least one second cable each may comprise a stop at either end thereof and wherein the extent of slip of said at least one cable in said attachment is limited by said stops. Optionally a loop may be formed in at least one end of the at least one first cable, and the loop passes over the spring steel post of said first and second barrier islands, said loop forming said stop. Optionally the loop may be formed in at least one end of the at least one second cable, and the loop passes over the attachment means of said first and second barrier islands, said loop forming said stop.

The attachments may comprise clamps which clamp the at least one first cable against the spring steel posts of the first and second barrier islands, and which clamp the at least one second cable against the attachment means of the first and second barrier islands. The clamps may comprise one or more U-bolts passing through holes provided in said spring steel posts and in said attachment means.

In an embodiment the security barrier section comprises said attachment means on the front and rear face, optionally two attachment means are provided on said front and/or said rear face. The at least one second cable may comprise a second cable extended between the attachment means on the front faces of said first and second barrier islands and a second cable extended between the attachment means on the rear faces of said first and second barrier islands. As described above, such an embodiment is advantageous in that it offers impact protection from two directions. It will also be appreciated that such a design enables the use of symmetrical barrier islands which greatly simplifies and expedites assembly as the barrier islands can be quickly installed without the need to orientate them facing a particular direction In a preferred embodiment the attachment means comprises a spring steel attachment post extending from at least one of said front and said rear face, the attachment post may be a spring steel post. Optionally each cast concrete block may comprise at least one opening extending there through and opening onto the front face and the rear face, said opening for receiving said steel attachment post there through such that it extends from either end thereof. The at least one opening may comprise a steel tubular member extending from said front face to said rear face, said steel tube being cast into said concrete block. In this manner the steel attachment post an easily be inserted and removed from the concrete blocks. This enables the concrete blocks to be loaded for transport closely abutting one another and the steel attachment posts simply slotted into place in situ. The use of spring steel for the attachment post ensures that under impact some of the forces acting on it from the second cable(s) is dissipated within the attachment post which, being spring steel will undergo elastic deformation rather than the plastic deformation that would be experienced if standard steel were used.

In a preferred embodiment each cast concrete block comprises a steel post footing cast therein which opens onto a top face thereof. The steel post footing comprises a substantially vertical tubular member for receiving said spring steel post therein. This enables the concrete blocks to be arranged in a compact manner for transportation without the spring steel post extending therefrom.

The security barrier section according to any one of the preceding claims wherein each said cast concrete block further comprises a plurality of fence post recesses located adjacent the front and/or rear face, each said fence post recess comprising a substantially vertical tubular steel member embedded each said cast concrete address and opening onto top face thereof. A fence post may be located in each said fence post recess and such that it extends substantially vertically therefrom. A fence panel may be attached to said fence posts. Optionally the barrier section further comprises a plurality of fence support members and said fence panel is attached to the fence support members and each said fence support member is attached to a fence post. By providing fence post recesses adjacent both the front and the rear face a fence can be provided on both sides thereof, further enhancing the double sided protection described above.

In an embodiment each cast concrete block comprises a rebar cage comprising a first and second plurality of substantially rectangular rebar sections arranged substantially perpendicularly to each other, said rebar cage encased in said concrete block.

The security barrier section may comprise an intermediate barrier island comprising a cast concrete block and a cable support post extending therefrom, said intermediate barrier island located between said first and second barrier islands, and wherein said at least one first cable is attached to said cable support post.

According to another aspect of the invention there is provided a security barrier comprising a plurality of security barrier sections according to another aspect of the invention, and wherein adjacent security barrier sections share a common barrier island. The attachment means may comprise U-bolts passing through said spring steel posts and the at least one first cables of adjacent security barrier sections may share common U-bolts. Optionally at least one common barrier island constitutes a corner island arranged between two adjacent barrier sections, the two adjacent barrier sections meeting at an included angle of less than 180°.

According to a further aspect of the invention there is provided a barrier island for a security barrier, said barrier island comprising: a cast concrete block having a front face and a rear face and surrounding a steel structure; a spring steel post extending upwardly from a top face of the cast concrete block at a location between the front face and the rear face for, in use, attaching at least one first cable thereto by first cable attachments such that the first cable can slip in said first cable attachments under loading; and attachment means located on, or extending from, at least one of the front face and the rear face of said cast concrete block for, in use, attaching at least one second cable thereto by second cable attachments such that the second cable can slip in said second cable attachments under loading.

Optionally the steel structure further comprises: first and second steel tubular members each arranged to extend from the front face to the rear face and opening at said respective front and rear faces, said first and second steel tubular members for receiving said attachment means; a steel post footing comprising a substantially vertical steel tubular member opening onto and extending downwardly from the top face, said steel post footing receiving said spring steel post therein; and a rebar cage comprising a first and second plurality of substantially rectangular rebar sections arranged substantially perpendicularly to each other. The steel structure may also comprise one or more of: a plurality of fence post recesses located adjacent the front and/or rear face, each said fence post recess comprising a substantially vertical tubular steel member opening onto said top face of the cast concrete block; and a plurality of attachment points each comprising a threaded steel member said threaded steel members located such that they open onto, or extend from, the top face of the cast concrete block.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the invention will now be described, by way of example only, with reference to the accompanying drawings, in which, in an embodiment of the invention.

DETAILED DESCRIPTION

Figure 1:
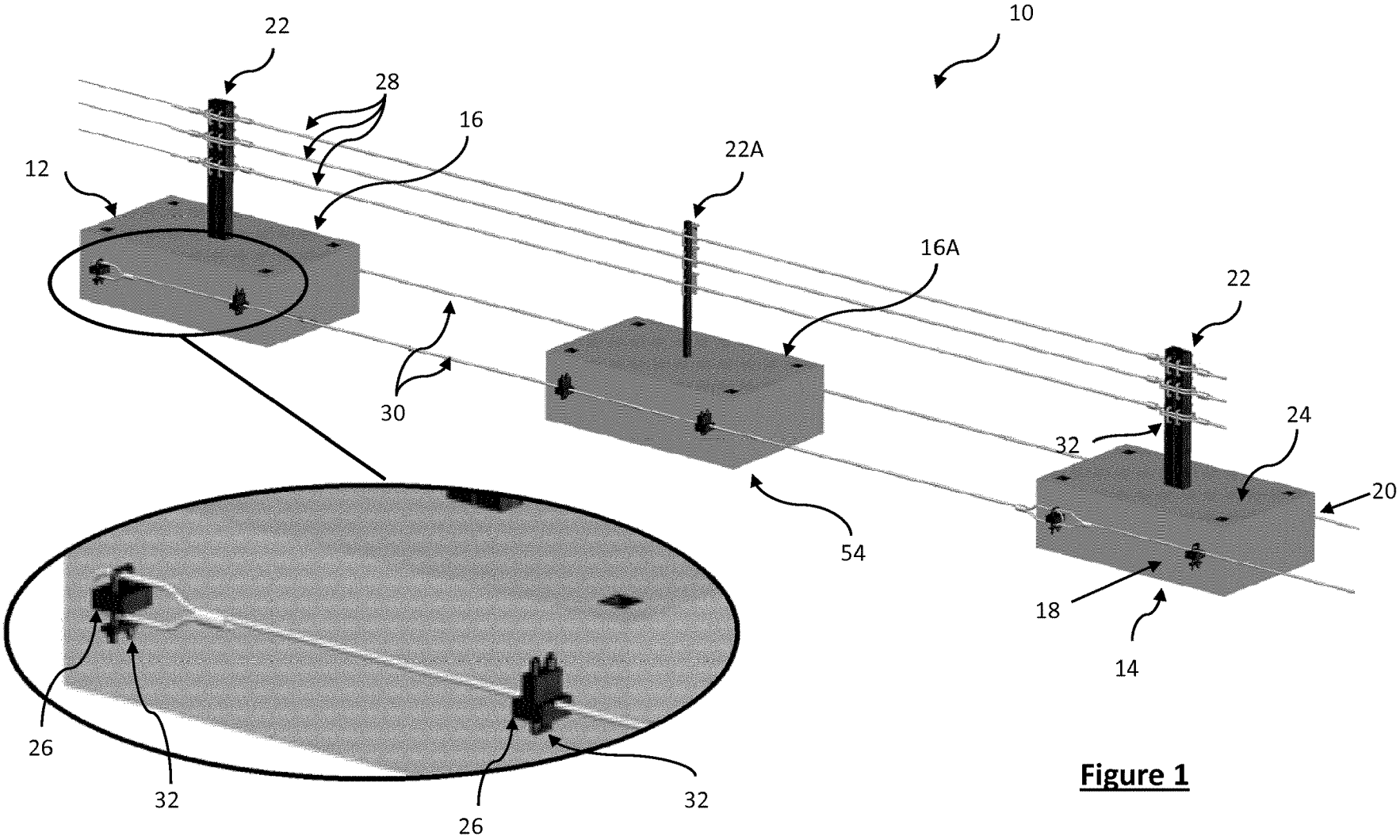
FIG. 1 shows an embodiment of a security barrier section according to an aspect of the invention, and a close up of a section thereof.

Referring to FIG. 1 a security barrier section 10 is shown. The security barrier section 10 comprises first and second barrier islands 12, 14 each of which comprise a cast concrete block 16 having a front face 18 and a rear face 20. The security barrier islands are designed to be simply placed on the surface where a security barrier is needed, i.e. they provide a surface mount security barrier that does not need to be located in an excavated trench and does not need to be attached to the surface. The concrete block 16 is described in more detail with reference to FIGS. 2 and 3 below.

A spring steel post 22 extends upwardly from a top face 24 of the cast concrete block 16 at a location between the front face and the rear face. As can be seen in the example embodiment the spring steel post 22 is located substantially in the centre of the concrete block 16. The exact location of the spring steel post 22 is not critical providing that it is spaced from either the front or the rear face, whichever is, in use, intended to face the direction from which it is designed to receive an impact for reasons that will be described in detail below. In the example embodiment it is an advantage of locating the spring steel post 22 substantially in the centre of the concrete block 16 in that a substantially symmetric barrier island 12, 14 is created. By providing a symmetrical barrier island the installation is simplified in that the concrete blocks 16 can be placed in either orientation without detriment to the performance of the barrier. Preferably the spring steel post is located at a position which is a minimum of 500 mm from the front/rear face of the concrete block 16. In an example embodiment the distance from the front face to the rear face is 1200 mm and the spring steel post 22 is located equidistance from face.

A pair of attachment means 26 extends from the front face 18 and the rear face 20 of the concrete block 16. Three steel cables 28, which may be referred to as first cables, extend between the spring steel posts 22 of the first 12 and second 14 barrier islands. In addition an individual cable 30, which may be referred to as a second cable extends between the attachment means 26 of the first and second barrier islands on each of the front faces and the rear faces thereof. The first 28 and second 30 cables are attached to the spring steel posts 22 and the attachment means 26 by respective first and second cable attachments 32 which are configured to allow said cable to slip therein under loading. Any suitable cable attachments may be used but in the example embodiment the cable attachments 32 comprise U-bolts which clamp the first cables 28 against the spring steel posts 22 of said first and second barrier islands, and which clamp the at least one second cable 30 against the attachment means 26 of said first and second barrier islands. The U-bolts 32 pass through holes provided in said spring steel posts 22 and in the attachment means 26 and have a plate on their opposite face against which the nuts of the U-bolt 32 are tightened thereby forming a clamp. Although the embodiment described herein has three first cables, and a single second cable on each side thereof, it will be appreciated that different numbers of first cables and second cables may be used. Furthermore although it is advantageous to provide second cables on both the front and rear faces thereof it will be appreciated that the second cable in some embodiments may only be provided on an impact facing side of the barrier section. It will be appreciated that the number of first and second cables and their respective sizes may be varied, in particular they may vary in dependence on the sped of impact which the barrier is intended to withstand.

A loop is formed in each end of the cables 28, 30, which pass over the spring steel posts 22 and the attachment means 26, of the first and second barrier islands. In use the loop forms a stop to limit the extent to which the cables 28, 30 may slip in the cable attachments 32 under impact. The arrangement of the loops of the first cables 28 will be understood by reference to WO2015033100, in particular FIGS. 12 and 13, the full contents of which are incorporated herein by reference.

The attachment means 26 are located at a position in the range of up to a maximum of 400 mm, preferably less than 350 mm, and in the preferred embodiment in range of 200 mm to 300 mm, above a bottom face of the cast concrete block 16, such that in use the second cables 30 extending therefrom are maintained at a height of up to 400 mm above the surface on which the barrier section is placed.

A shown in the example embodiment an intermediate barrier island 54 can be provided between the first and second barrier islands. The intermediate barrier island comprises a cast concrete block 16A and a cable support post 22A extending therefrom. The first cables 28 are attached, approximately at their mid points, to the cable support post 22A. Optionally, in some embodiments, the second cables may also be attached to the intermediate barrier islands. The intermediate barrier islands 54 can be smaller than the first 12 and second 14 barrier island and prevent the cables from sagging at their mid points, thereby enabling a greater distance between the first 12 and second 14 barrier islands. The concrete blocks 16A of the intermediate barrier islands 54 may have a substantially similar structure as the concrete blocks 16 of the barrier islands 12, 14, albeit they may be dimensionally smaller and the post footing (see below) may be dimensioned to receive a substantially smaller post 22A.

Figure 2:
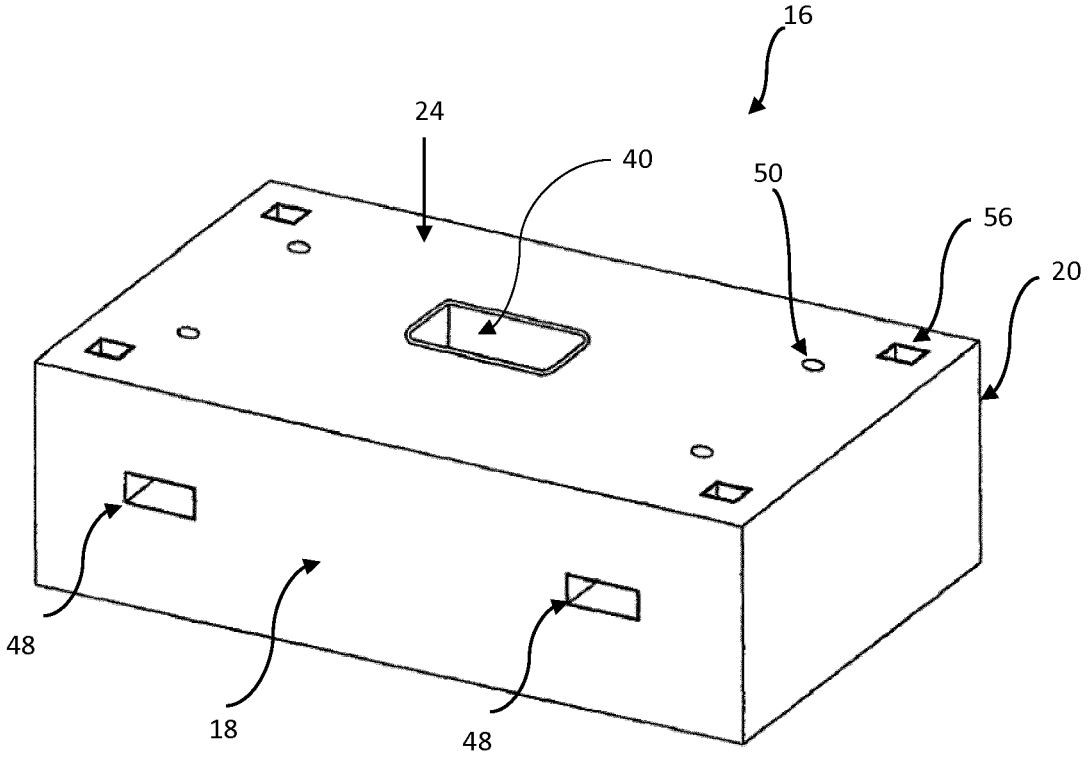
FIG. 2 shows an embodiment of a cast concrete block of a security barrier island according to an aspect of the invention.
Figure 3:
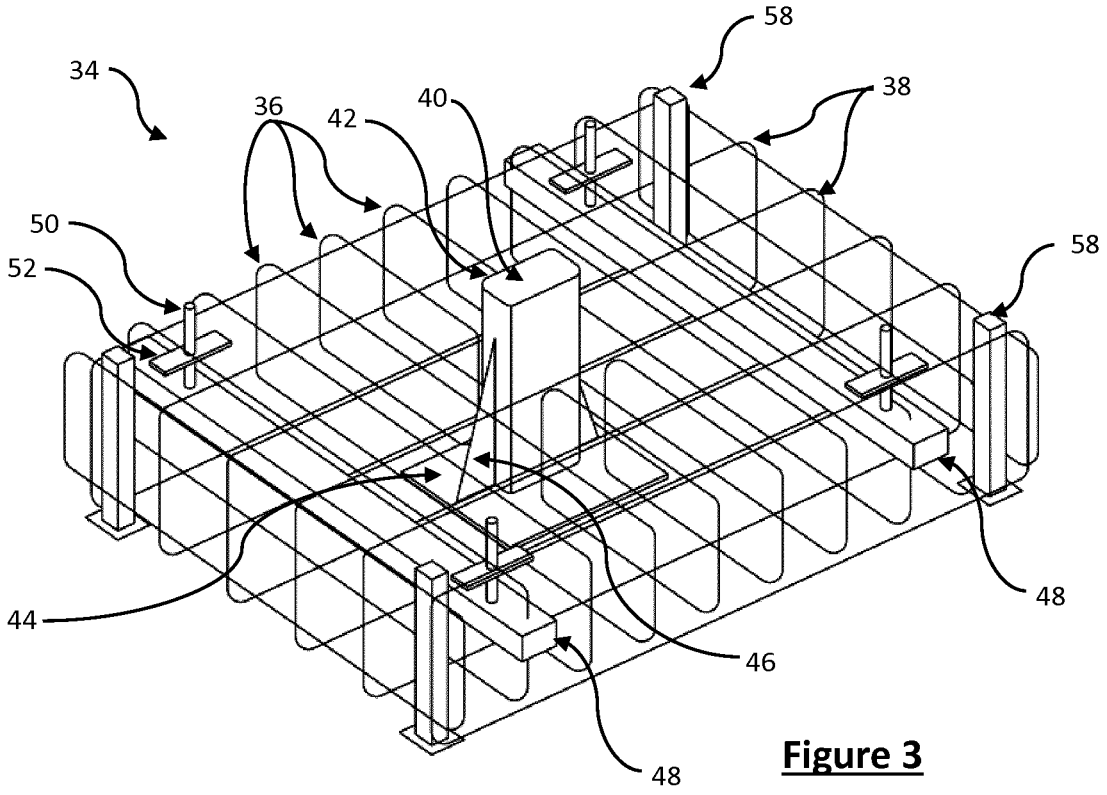
FIG. 3 shows the internal steel structure of the cast concrete block shown in FIG. 2.

Referring now to FIG. 2 and FIG. 3 the structure of the cast concrete block 16 is described in detail. The concrete block 16 comprises an internal steel structure 34 that is substantially enclosed in concrete. It will be understood that the concrete blocks 16 are pre-cast concrete blocks that are preferably prefabricated and transported to their place of installation, however it is to be understood that the cast concrete blocks could also be cast on location prior to being formed into a barrier.

As shown in FIG. 3 the steel structure 34 comprises a rebar cage comprising a first 36 and second 38 plurality of substantially rectangular rebar sections arranged substantially perpendicularly to each other. Centrally located in the steel structure is a steel foot box 40 which comprises a vertical tubular section 42 attached to a base plate 44 and supported thereon by a plurality of ribs 46. The steel foot box 40 receives the spring steel post 22 therein. The tubular section 42, base plate 44 and ribs 46 are welded together to make a single structure 40.

As can be seen, the rectangular rebar sections pass at least partially over the base plate 44 of the steel foot box 40. The steel structure 34 also includes first and second attachment means receivers 48, each of which comprise a steel tubular members, e.g. a section of steel box section, that extends in a direction from the front face to the back face of the concrete block 16. In use the first and second attachment means receivers 48 each for receive an attachment means 26 therein in a manner that they extend from the front and rear face of the concrete block. The attachment means 26 that are received in each attachment means receiver 48 each comprise a spring steel member with a pair of holes in either end thereof for receiving the U-bolts. Preferably the each attachment means receiver 48 has an internal width of at least 120 mm and the each attachment means receivers 48 are spaced at an internal spacing in the region of 1000 mm to 1500 mm. These dimensions can enable a fork lift truck to insert its forks into the attachment means receivers 48 to easily lift and move the cast concrete blocks 16. In an alternative embodiment, not shown, the attachment means 26 comprising a spring steel member with a pair of holes in either end thereof may form part of the steel structure 34 in place of the attachment means receivers 48 such that they are cast into the concrete block 16.

Figure 4:
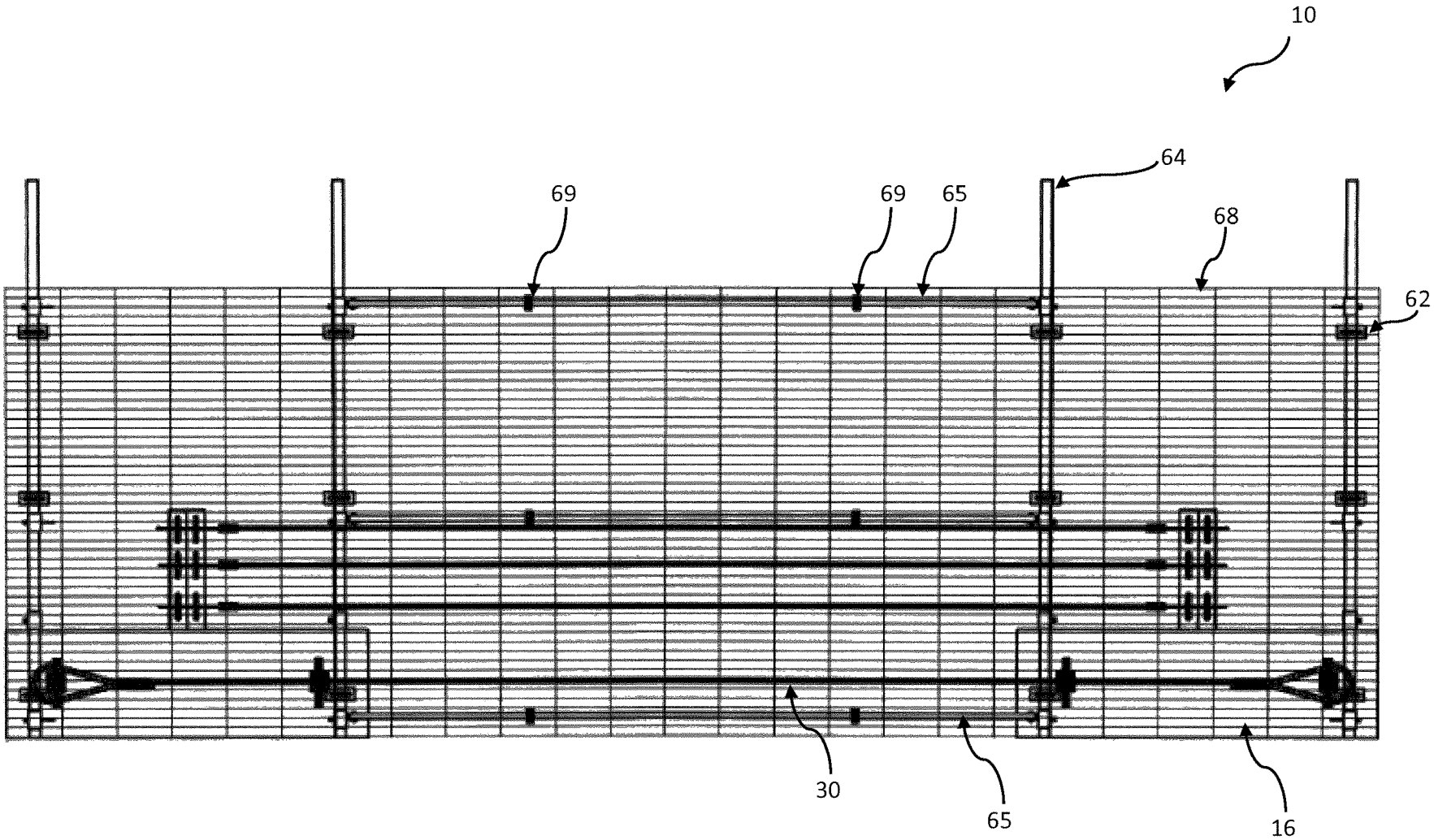
FIG. 4 shows a front view of a barrier section according to the invention.

The steel structure of the example embodiment shown in the FIGS. 3 and 4 also includes some optional additional features. The steel structure 34 includes an of attachment point, each comprising a threaded steel member 50, which may be a male or female threaded member, located substantially in each of the four upper corners in a position that, once the concrete block 16 is cast around the steel structure 34 open onto, or extend from, the top face 24 of the cast concrete block 16. Each threaded steel member 50 is attached to a steel anchoring plate 52 that assists in securing the attachment points in the concrete bock. In use, lifting attachments can easily be attached to the threaded members 50 such that the concrete blocks 16 can easily be lifted by an overhead lifting machine, for example a crane or hoist.

A further optional feature that is included in the example embodiment is the inclusion, in the steel structure 34, of a plurality of fence post recesses 56 located adjacent the front and/or rear face, each said fence post recess comprising a substantially vertical tubular steel member 58. In use the fence post recesses 56 receive a fence post such that a fence can be attached to the concrete blocks. As shown in FIGS. 2 and 3 a fence post recess 56 is provided substantially in each corner of the concrete block such that a fence panel can be provided adjacent each of the front 18 and the rear 20 faces of the barrier section.

All of the components of the steel structure may be welded or brazed together to form a unitary structure 36 which is then either placed in a mould, or shuttering is assembled therearound and concrete is poured around the structure to substantially surround it. The mould/shuttering is dimensioned such that the foot box 40, the threaded members 50, and the fence post recesses 56 open substantially onto the top face 24 of the concrete block 16 and the attachment means receivers 48 open onto the front 18 and rear 20 faces of the concrete block 16. In an example embodiment the concrete block is dimensioned 2000 mm×1200 mm×600 mm (+/−50 mm).

Figure 5:
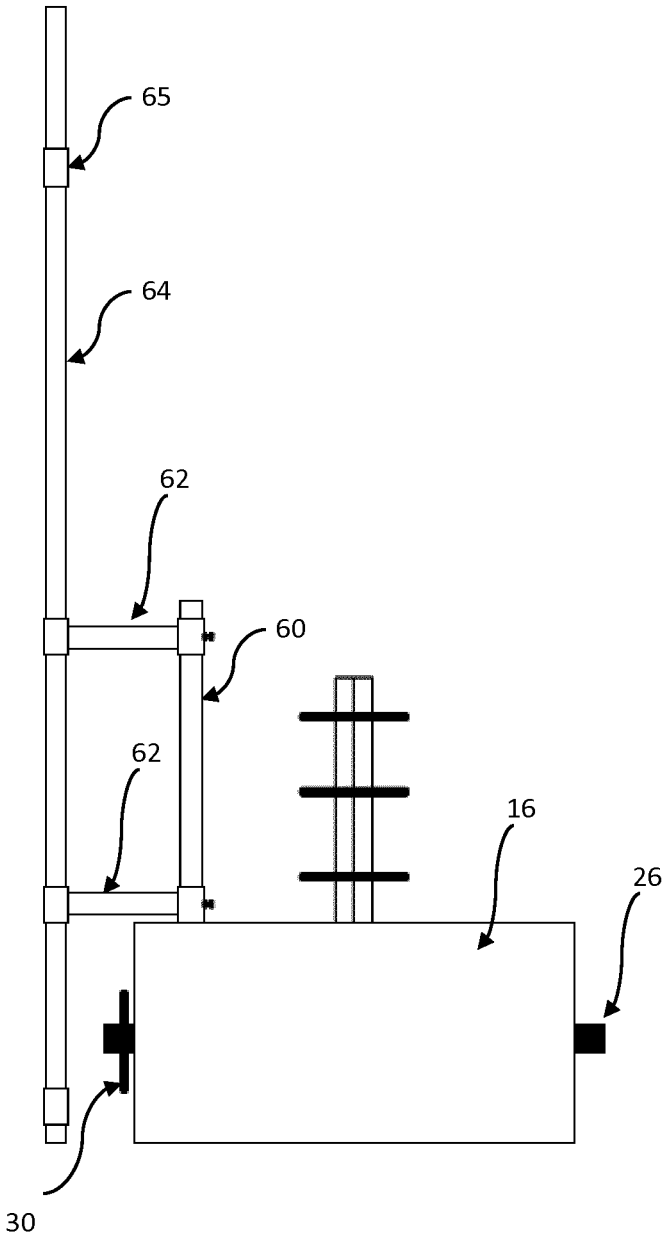
FIG. 5 shows a side view of the barrier section of FIG. 4.
Figure 6:
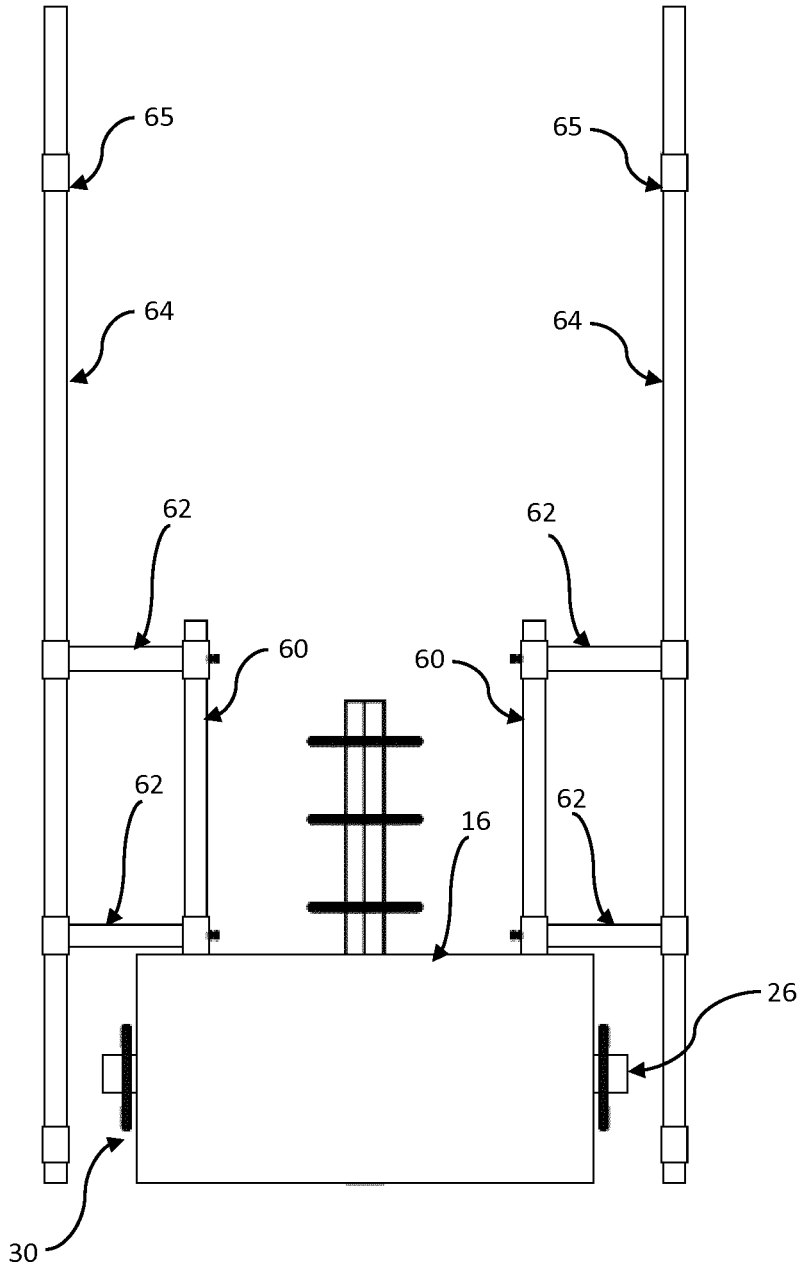
FIG. 6 shows a side view of a double sided barrier section of the invention.

Referring now to FIGS. 4 and 5 a barrier section 10 is shown having a fence post 60 located in each said fence post recess 56 and extending substantially vertically therefrom. Attached at one end to each fence post 60 is a pair of fence spacers 62. The fence spacers are each attached at their other end to a fence support member 64 to which a fence panel 68 is attached. By means of the fence support member 64 and the fence spacers 62 the fence panel 68 is attached to the fence posts 60 located in the fence post recesses 56 of each barrier island. Although it will be appreciated that the fence panel 60 could be attached directly to the fence posts the described arrangement enables the fence panels to be located forward of the concrete blocks 16 and attached second cables 30 so that they do not interfere therewith. Additional longitudinal fence braces 65 are provided extending between the fence posts of adjacent concrete blocks. Although shown without an intermediate barrier island, it will be appreciated that the intermediate barrier island, when used, can be provided with the same of a similar arrangement to provide further fence support structures. The fence panel 68 may be attached by means of simple U-bolts 69 or other easily attachable and releasable connectors, for example zip ties. FIG. 6 shows a side view similar to that of FIG. 5 except in that fence posts 60, spacers 62 and fence support members 64 are provided on both sides thereof 60, and to effect a symmetrical barrier. This design enables a fence to quickly be erected on the concrete blocks 16 that can then provide a single, or double, pedestrian barrier as well as a vehicular barrier.

Figure 7:
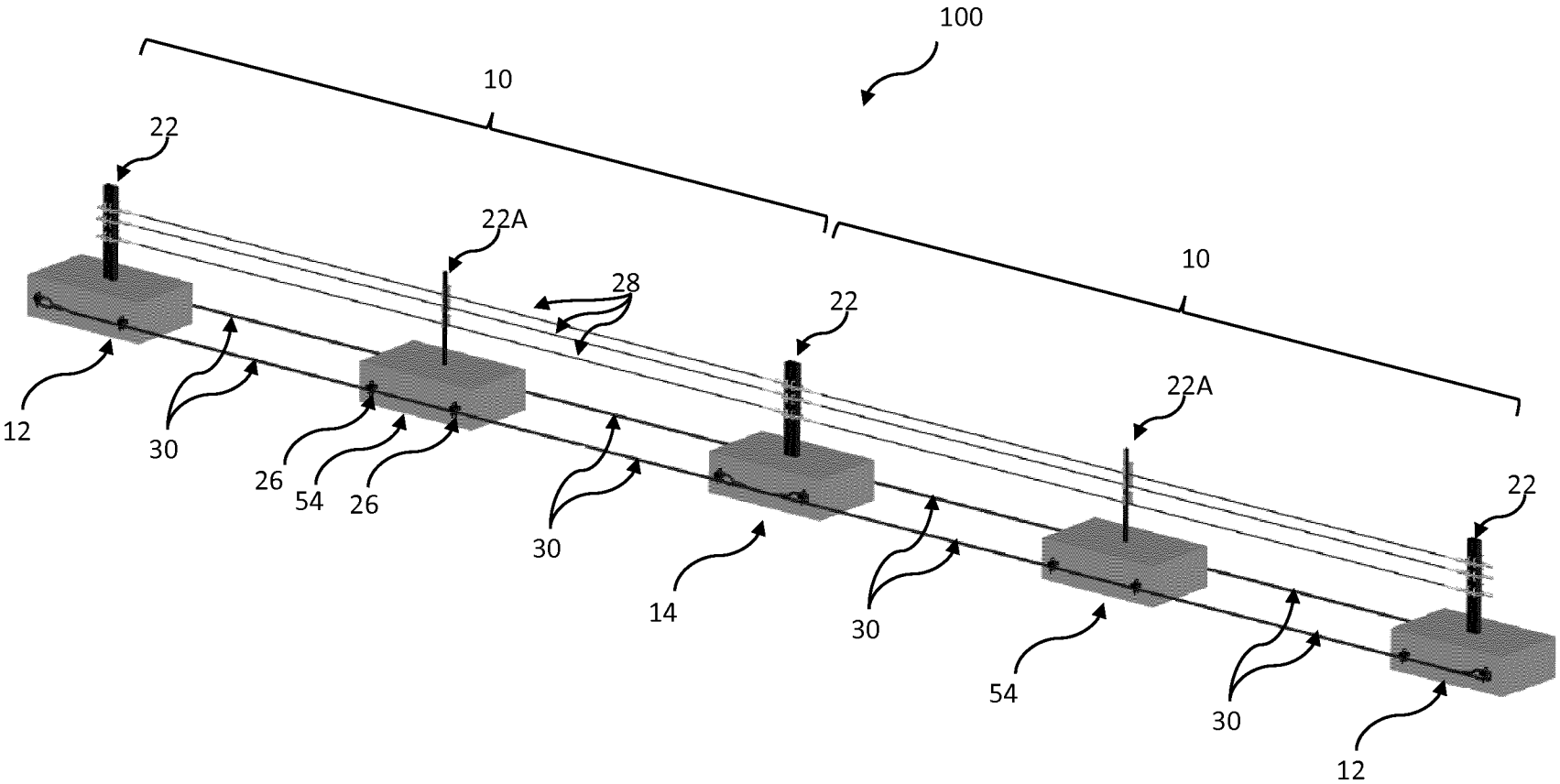
FIG. 7 shows an embodiment of a security barrier in accordance with the invention.

Referring to FIG. 7 a security barrier 100 is shown. The security barrier comprises a number of the security barrier sections 10 connected together such that adjacent security barrier sections share a common barrier section island 14. The U-bolts passing through the spring steel post 22 of the common barrier section island 14 are shared U-Bolts common to the first cables 28 from the adjacent barrier sections. Although not shown, it will be appreciated that the common barrier island 14 may constitutes a corner island arranged between two adjacent barrier sections, the two adjacent barrier sections meeting at an included angle of less than 180.

The barrier is installed as follows. Approximately 6 meter centres are marked on the ground along the intended line the barrier and barrier islands 12, 14 and intermediate barrier islands 54 are placed on alternate centre marks. This is repeated along the run of the barrier and a barrier island 12, 14 is placed on the final centre mark. Next the spring steel posts 22 are inserted into the foot boxes 40 of the barrier islands 12, 14 and the cable support posts 22A are inserted into the foot box of the intermediate barrier islands 54. The posts may be secured in place in the foot box 40 by using pieces of packing material (which may be in the form of steel shims or the like) and additionally grout may be applied around the posts 22, 22A. Although described as being done in situ, it will be appreciated that the barrier islands may be transported to the site of the barrier with the spring steel posts 22 already in place in the foot boxes 40

Next the spring steel members of the attachment means 26 are located through the attachment means receivers 48 so that they extend from either side thereof, and are secured in place by the use of pieces of packing material. This is preferably done on site so that the barrier islands can be closely packed in transit with reduced risk of damage from or to the attachment means 26. The second cables 30 are then located over the protruding end of the first spring steel member of the attachment means 26 of the first barrier island, across the front face of the barrier island 12 and under the second spring steel member of the attachment means. The cable 28 is then attached to the second barrier island 14 in a symmetrical manner, i.e. passing under the first attachment means 26 thereof and looping over the second attachment means 26 thereof. In between the first 12 and second 14 barrier islands, the second cables 30 pass under the attachment means of the intermediate barrier island 54.

Although described as under the attachment means 26, in some embodiments, in order to facilitate the assembly of the security barrier, the cables 30 could pass over the attachment means 26 so that the weight of the cable will be supported until it is attached. This, however, this will be at the detriment of force distribution during an impact. The second cables 30 are then clamped to each of the attachment means 26 by use of U-bolts. The ends of the cables 30 are tensioned such that a there is a gap between the end of loop in the cable and the attachment means such that under impact the cable undergo a limited amount of slip until the end of the loop abuts the attachment means, thereby preventing any further slip through the U-bolts. The U-bolts are torqued to 14.12 Nm (125 Lb/Inch).

Next the first cables 28 are fitted to the spring steel posts 22. Where multiple cables are fitted the lower cables are fitted first along the full run of the barrier and then the sequentially higher cables ones, again along the complete run. A first looped end of the cable 28 is placed over the spring steel post 22, a U-Bolt is pushed through holes in the post at the attachment position to loosely attach the cable to the post. This is then repeated at the second end of the cable 30. The cable is the pulled such that there is a gap between the end of the loop and the post 22 and the U-bolt at the first end is then tightened. This is then repeated at subsequent posts 22 along the run of the barrier. Where a post 22 supports cables running in both directions both cables will need to be in situ and the U-bolts tensioned such that there is gap between the ends of the loops of both cables and the post 22. This arrangement is shown in WO2015033100 as mentioned above. Preferably the gap between the ends of the loops of the cables 28 and the posts 22 is over 60 mm, preferably in the range of 60-100 mm, although it will be appreciated that a bigger gap can be employed if necessary to tighten the cable. It will be understood that in the context used herein tensioning or tightening the cables is not intended to imply that the cables 28, 30 are under a high tension, the tensioning is merely intended to result in maintaining the cables at the required height with minimal amount of sag there between. Once attached to the spring steel posts 22 U-bolts are used to attach the cables 28 to the cable support posts 22A of the intermediate barrier islands 54 to support them and reduce any sag at their mid-point. The U-bolts are initially tightened to a torque of approximately 7.34 Nm (65 lb/in) and once the cables have been checked to ensure that they are at the appropriate position on the cable support posts the U-bolts can be fully tightened to a torque off 125 lb/inch. Although not shown in FIG. 7 it will be appreciated that the fence posts 60, fence spacers 62, fence support members 64 and fence panels 68 as described above with reference to FIGS. 4 to 6 can then be assembled onto the security barrier 100.

Figure 8:
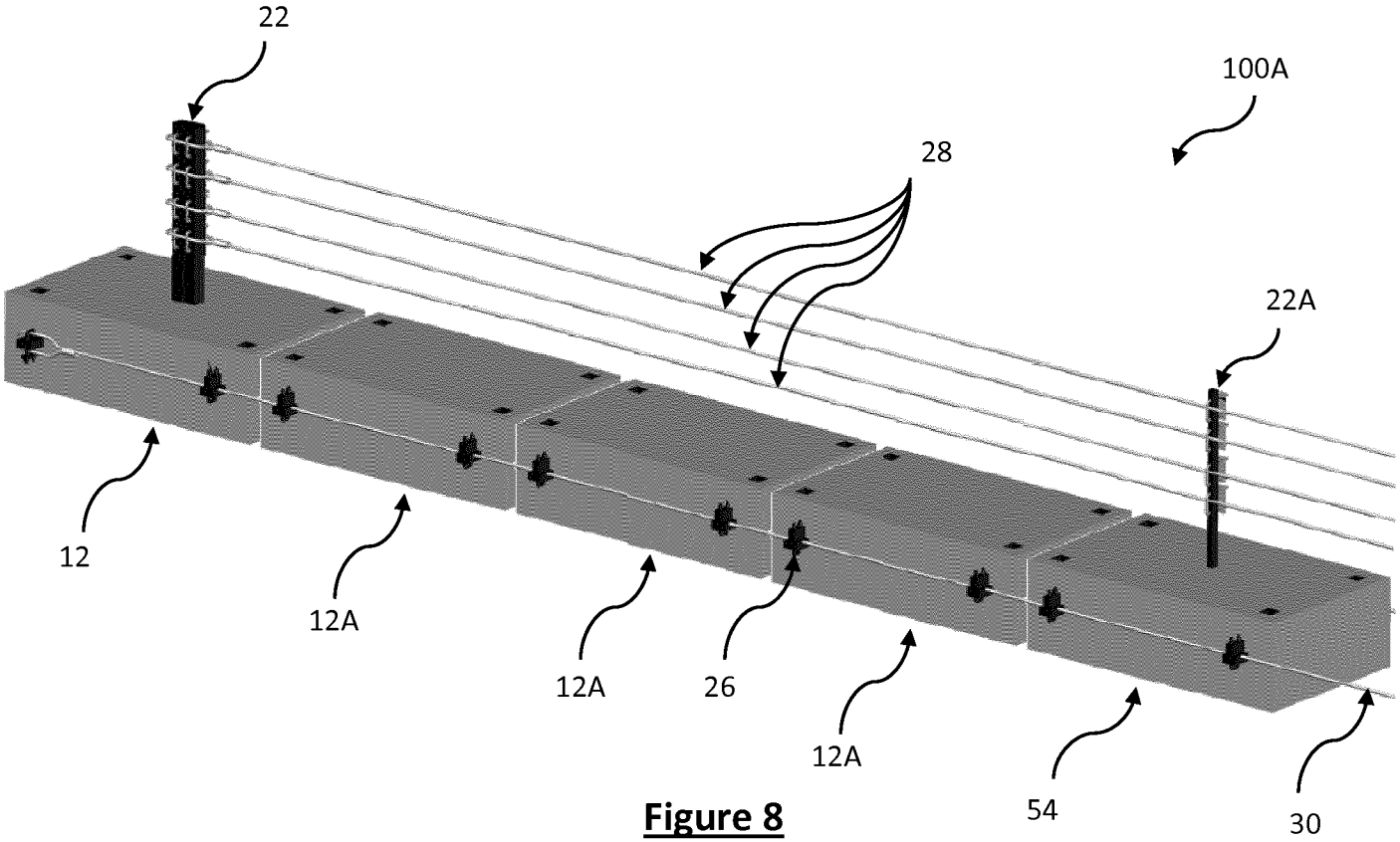
FIG. 8 shows an embodiment of the end of a security barrier in accordance with the invention.

Referring to FIG. 8 an example embodiment of the end of a security barrier 100A is shown which is designed to withstand a high speed impact force. Where the barrier is intended to be used to withstand higher speed impacts, and therefore higher impact forces, in order to stop the barrier being dragged further than acceptable, in particular if the impact occurs near the end of the barrier, additional barrier islands 12A, with the spring steel posts 22 omitted, may be daisy chained together by means of attaching the second cables 30 to the attachment means 26 of each said additional barrier islands 12A, such they extend from the end barrier island 12 of the barrier in the direction of the first intermediate island 54. In addition an additional first cable 28 is used. As shown in FIG. 8 three additional barrier islands 12A have been added such that they extend fully between the end barrier island 12 and the adjacent intermediate island 54. This increases the mass at the ends of the security barrier thereby increasing the impact force that the barrier can disperse. It will be appreciated that different numbers of additional barrier islands may be selected depending on the weight of each barrier island and the force of impact the barrier is designed to protect against.

When an attacking vehicle runs into the security barrier 100 of the invention line it will first run over the second cables 30 fitted to the front face of the barrier islands block via the spring members of the attachment means 26 running through the concrete blocks 16. Due to the height of the cables (preferably less than 350 mm) the second cable 30 will impact below the mid-point of the front tyres of the vehicle and accordingly will pass under the vehicle. At this point impact energy is already starting to be absorbed by the barrier as the second cable 30 slips in its U-bolt thereby dissipating energy. The vehicle will continue to move forward until it engages with the first cables 28 fitted to the spring steel posts 22. Again, the impact on these cables 28 will then pull the cable loops through the U-bolts until they abut the spring steel posts which in turn will flex further absorbing the impact energy and slowing the vehicle down, and transferring impact force into the cables of the adjacent barrier section which are also attached to the same spring steel post. This gradual dispersion of energy which slows the vehicle greatly reduces the ultimate impact force as it spreads the impact over a longer period of time. For example, for a 7 tonne truck a reduction in speed from 80 km/h (50 mph) to 64 km/h (40 mph) results in a reduction in impact force of approximately 70 tonnes. Bu the time that the vehicle impact force transfers fully onto the first cables 28 the attacking vehicle will have run over the second cables 30 fixed to the concrete blocks 16 and will be under the vehicle. This in effect anchors the concrete blocks 16 to the vehicle and prevents them from becoming airborne. In this regard it is advantageous that the second cables 30 are run underneath the attachment means 26 as the force is directed directly onto the spring steel member of the attachment means 26, which passes through the concrete block 16, by the cable, whereas is they were located on top of the attachment means the U-bolts attaching the cables 30 to the attachment means 26 would become a part of the force transmission path between the vehicle and the mass of the concrete block 16. This anchoring effect ensures that as the blocks are dragged their weight is maintained in opposition to the vehicle and as they start to move the impact force is further dissipated in adjacent barrier sections as they come under full loading, thereby bringing the vehicle to a stop. Accordingly it will be appreciated that, in a surface mount environment where the concrete blocks 16 are not embedded in or attached to the ground the second cables 30 play a vital role under impact by effectively anchoring the barrier to the vehicle.

A fence as described herein was set up with the barrier islands freely place on a concrete surface and was tested by a controlled 90° collision with a 7.5 tonne truck, in accordance with BSI-IWA 14-1:2013 testing for vehicle security barriers, and met the requirements of the test in a collision with a 7.5 tonne truck travelling at 30 mph. The bollard described herein is, to the inventors knowledge, the world's first freestanding surface mount fence to pass this test.

It will be understood that the embodiments described above are given by way of example only and are not intended to limit the invention, the scope of which is defined in the appended claims.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

The invention claimed is:

1. A security barrier section comprising:

first and second barrier islands, each said island comprising:

a cast concrete block having a front face and a rear face; a spring steel post extending upwardly from a top face of the cast concrete block at a location between the front face and the rear face; and attachment means located on, or extending from, at least one of the front face and the rear face;

at least one first cable extended between the spring steel posts of said first and second barrier islands and attached thereto by first cable attachments;

at least one second cable extended between the attachment means of said first and second barrier islands and attached thereto by second cable attachments; wherein said first and second cable attachments are configured to allow said cable to slip in said cable attachment under loading, and said at least one first and at least one second cable each comprises a stop at either end thereof and wherein the extent of slip of said at least one cable in said attachment is limited by said stops.

2. The security barrier section according to claim 1, wherein a loop is formed in at least one end of said at least one first cable, and said loop passes over the spring steel post of said first or second barrier island, said loop forming said stop.

3. The security barrier section according to claim 1, wherein a loop is formed in at least one end of said at least one second cable, and said loop passes over the attachment means of said first or second barrier island, said loop forming said stop.

4. The security barrier section according to claim 1, wherein said attachments comprise clamps which clamp the at least one first cable against the spring steel posts of said first and second barrier islands, and which clamp the at least one second cable against the attachment means of said first and second barrier islands.

5. The security barrier section according to claim 1, comprising two attachment means, one on each of said front and rear faces, wherein said at least one second cable comprises a second cable extended between the attachment means on the front faces of said first and second barrier islands and another second cable extended between the attachment means on the rear faces of said first and second barrier islands.

6. The security barrier section according to claim 1 wherein said attachment means comprise a steel attachment post extending from at least one of said front and said rear face.

7. The security barrier section according to claim 6 wherein each said cast concrete block comprises at least one opening extending there through and opening onto the front face and the rear face, said opening for receiving said steel attachment post there through such that it extends from either end thereof, and wherein said at least one opening comprises a steel tubular member extending from said front face to said rear face, said steel tube cast into said concrete block.

8. The security barrier section according to claim 1 wherein each said cast concrete block comprises a steel post footing cast therein and opening onto the top face thereof, said steel post footing comprising a substantially vertical tubular member for receiving said spring steel post therein.

9. The security barrier section according to claim 1 wherein each said cast concrete block further comprises a plurality of fence post recesses located adjacent the front and/or rear face, each said fence post recess comprising a substantially vertical tubular steel member embedded into each said cast concrete block and opening onto top face thereof.

10. The security barrier section according to claim 9 further comprising a fence post located in each said fence post recess and extending substantially vertically therefrom, and a fence panel attached to said fence posts.

11. The security barrier section according to claim 10 further comprising a plurality of fence support members and wherein said fence panel is attached to said fence support members and wherein each said fence support member is attached to a fence post.

12. The security barrier section according to claim 1 wherein said at least one first cable comprises a plurality of cables extending between the spring steel posts.

13. The security barrier section according to claim 1 further comprising an intermediate barrier island comprising a cast concrete block and a cable support post extending therefrom, said intermediate barrier island located between said first and second barrier islands, and wherein said at least one first cable is attached to said cable support post.

14. A security barrier comprising a plurality of security barrier sections according claim 1, wherein adjacent security barrier sections share a common barrier island.

15. The security barrier according to claim 14, wherein said attachment means comprise U-bolts passing through said spring steel posts and wherein the said at least one first cables of adjacent security barrier sections share common U-bolts.

16. The security barrier according to claim 14, wherein at least one common barrier island constitutes a corner island arranged between two adjacent barrier sections, the two adjacent barrier sections meeting at an included angle of less than 180°.

17. A barrier island for a security barrier, said barrier island comprising:

a cast concrete block having a front face and a rear face and surrounding a steel structure;

a spring steel post extending upwardly from a top face of the cast concrete block at a location between the front face and the rear face for, in use, attaching at least one first cable thereto by first cable attachments such that the first cable can slip in said first cable attachments under loading;

and attachment means located on, or extending from, at least one of the front face and the rear face of said cast concrete block for, in use, attaching at least one second cable thereto by second cable attachments such that the second cable can slip in said second cable attachments under loading;

wherein said steel structure further comprises first and second steel tubular members each arranged to extend from the front face to the rear face and opening at said respective front and rear faces, said first and second steel tubular members for receiving said attachment means.

18. The barrier island according to claim 17 wherein said steel structure further comprises:

a steel post footing comprising a substantially vertical steel tubular member opening onto and extending downwardly from the top face, said steel post footing receiving said spring steel post therein; and a rebar cage comprising a first and second plurality of substantially rectangular rebar sections arranged substantially perpendicularly to each other.

19. The barrier island according to claim 17 wherein said steel structure further comprises:

a plurality of fence post recesses located adjacent the front and/or rear face, each said fence post recess comprising a substantially vertical tubular steel member opening onto said top face of the cast concrete block.

20. The barrier island according to claim 17 wherein said steel structure further comprises:

a plurality of attachment points each comprising a threaded steel member said threaded steel members located such that they open onto, or extend from, the top face of the cast concrete block.

* * * * *